US006044237A

United States Patent [19]

Numagami et al.

[11] Patent Number: 6,044,237

[45] Date of Patent: Mar. 28, 2000

[54] DEVELOPING APPARATUS

[75] Inventors: Atsushi Numagami, Hadano; Kazushi Watanabe, Mishima; Katsunori Yokoyama, Susono, all of Japan

[73] Assignee: Canon Kabushiki Kaisha, Tokyo, Japan

[21] Appl. No.: 09/177,121

[22] Filed: Oct. 22, 1998

[30] Foreign Application Priority Data

Oct. 30, 1997 [JP] Japan ..... 9-298354

[51] Int. Cl.[7] ..... G03G 15/08

[52] U.S. Cl. ..... 399/104; 399/105

[58] Field of Search ..... 399/104, 105, 399/103

[56] References Cited

U.S. PATENT DOCUMENTS 4,792,831 12/1988 Takeda et al. ..... 399/105
5,475,467 12/1995 Watanabe et al. .
5,697,021 12/1997 Watanabe et al. ..... 399/102

FOREIGN PATENT DOCUMENTS 7-306578 11/1995 Japan .

*Primary Examiner*—Matthew S. Smith
*Assistant Examiner*—Greg Moldafsky
*Attorney, Agent, or Firm*—Fitzpatrick, Cella, Harper & Scinto

[57] ABSTRACT

The present invention provides a developing apparatus comprising a developing container for containing magnetic developing agent, a developing agent bearing member provided an opening portion of the developing container and adapted to bear and convey the magnetic developing agent, a sheet member elastically biased against the developing agent bearing member along a longitudinal direction of the developing agent bearing member and adapted to close a gap between the developing agent bearing member and the developing container, a magnetic seal member provided at an end of the developing agent bearing member with a gap therebetween and adapted to form a magnetic seal, and an elastic member for urging the sheet member toward the developing agent bearing member.

8 Claims, 14 Drawing Sheets

DEVELOPING APPARATUS

BACKGROUND OF THE INVENTION

1. Field of the Invention

The present invention relates to a developing apparatus used in an image forming apparatus of electrophotographic or electrostatic recording type as a copying machine, a printer and the like and adapted to develop an electrostatic latent image on an image bearing member.

2. Related Background Art

In image forming apparatuses of electrophotographic or electrostatic recording type, an electrostatic latent image on an image bearing member has been developed by a developing apparatus containing a developing agent.

In the past, as shown in FIG. 14A, in order to prevent magnetic toner from leaking through a gap between a developing frame 12 containing the magnetic toner and a developing roller 9*c* for supplying the magnetic toner contained in the developing frame 12 to an electrophotographic photosensitive drum, as a sealing means for sealing gaps between the developing frame 12 and the developing roller 9*c* at both longitudinal ends of the developing roller 9*c*, elastic members 51 made of felt, rubber or the like have been used.

At a lower part of the developing roller 9*c*, sealing has been effected by abutting a sheet member 52 provided on the developing frame 12 against the lower part of the developing roller 9*c* along a longitudinal direction of the developing roller. Further, both longitudinal ends of the sheet member 52 have been pinched between the elastic members 51 and the developing roller 9*c* to prevent the magnetic toner from leaking through both longitudinal ends.

Alternatively, as shown in FIG. 14B, at both longitudinal ends of the developing roller 9*c*, sealing (for magnetic toner) has been effected by magnetic forces of magnets 63 disposed around peripheral surfaces of the both longitudinal ends of the developing roller 9*c* with small gaps "g" therebetween.

However, in the above-mentioned examples, as shown in FIG. 14A, when the elastic members 51 made of felt, rubber or the like are used as the sealing means between both longitudinal ends of the developing roller 9*c* and developing frame 12, since the both longitudinal ends of the sheet member 52 are pinched between the elastic members 51 and the developing roller 9*c*, both longitudinal ends of sheet member 52 abut against both longitudinal ends of the developing roller 9*c* without any gap. Thus, there is an advantage that the magnetic toner can surely be prevented from leaking through both longitudinal ends, but, in such an arrangement, an assembling operation is troublesome, and, since both longitudinal ends of the developing roller 9*c* are elastically urged by the elastic members 51, when the developing roller 9*c* is rotated, great load is generated to increase the rotational torque of the developing roller 9*c*.

On the other hand, as shown in FIG. 14B, when the magnets 63 are used as the sealing means between the both longitudinal ends of the developing roller 9*c* and the developing frame 12, since the magnets 63 do not abut against the developing roller 9*c*, the assembling operation becomes easy and the rotational torque of the developing roller 9*c* can be reduced. However, since there are small gaps g between the developing roller 9*c* and the magnets 63, the magnetic toner remains at opposed portions between the both longitudinal ends of the developing roller 9*c* and the magnets 63, with the result that the magnetic toner may be accumulated on the ends of the sheet member 52 abutting against the lower part of the developing roller 9*c*. In such a case, as shown in FIG. 14B, the accumulated magnetic toner forcibly urges the sheet member 52 downwardly to form gaps "h" between the developing roller 9*c* and the sheet member 52, with the result that the magnetic toner may leak through the gaps h.

SUMMARY OF THE INVENTION

An object of the present invention is to provide a developing apparatus in which magnetic end sealing can be effected.

Another object of the present invention is to provide a developing apparatus in which a developing agent can be prevented from leaking through a gap between a developing agent bearing member and a developing container.

A further object of the present invention is to provide a developing apparatus comprising a developing container for containing a magnetic developing agent, a developing agent bearing member provided on an opening portion of the developing container and adapted to bear and convey the magnetic developing agent, a sheet member elastically biased against the developing agent bearing member along a longitudinal direction of the developing agent bearing member to close a gap between the developing agent bearing member and the developing container, a magnetic sealing member provided at an end of the developing agent bearing member with a gap between to form a magnetic seal, and an elastic member for urging the sheet member toward the developing agent bearing member.

The other objects and features of the present invention will be apparent from the following detailed explanation of the invention referring to the accompanying drawings.

DETAILED DESCRIPTION OF PREFERRED EMBODIMENTS

The present invention will now be explained in connection with embodiments thereof with reference to the accompanying drawings.

Figure 1:
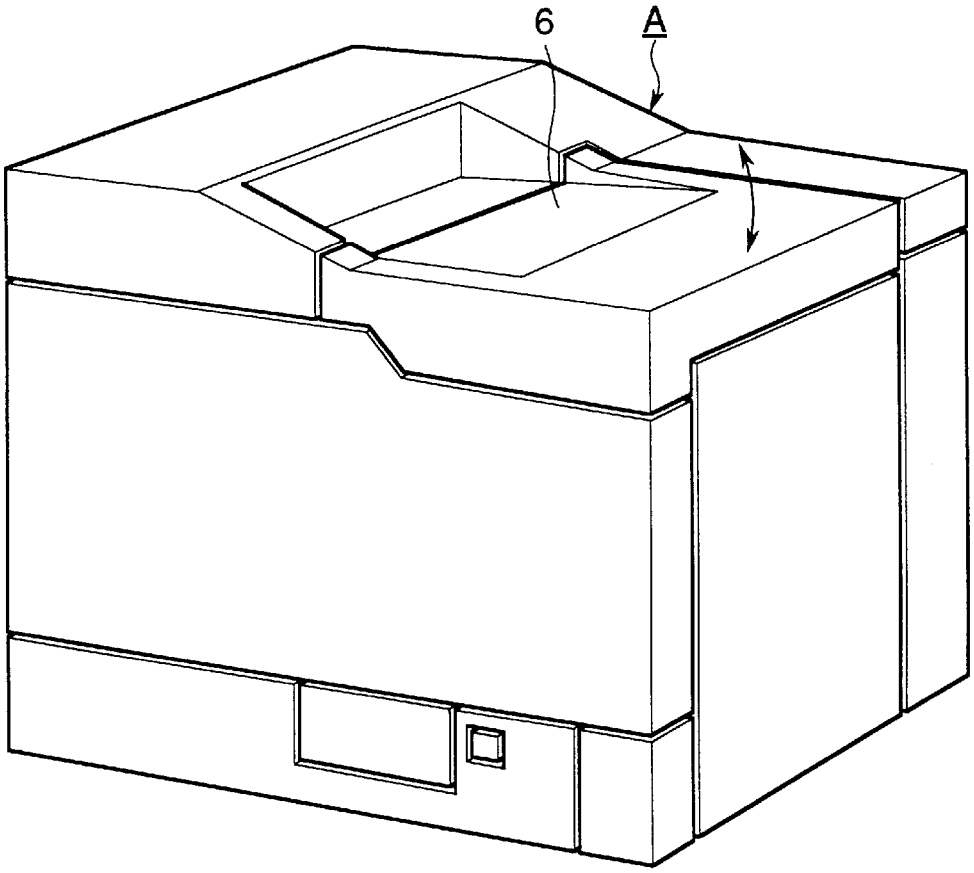
FIG. 1 is a perspective view of an image forming apparatus according to the present invention.
Figure 2:
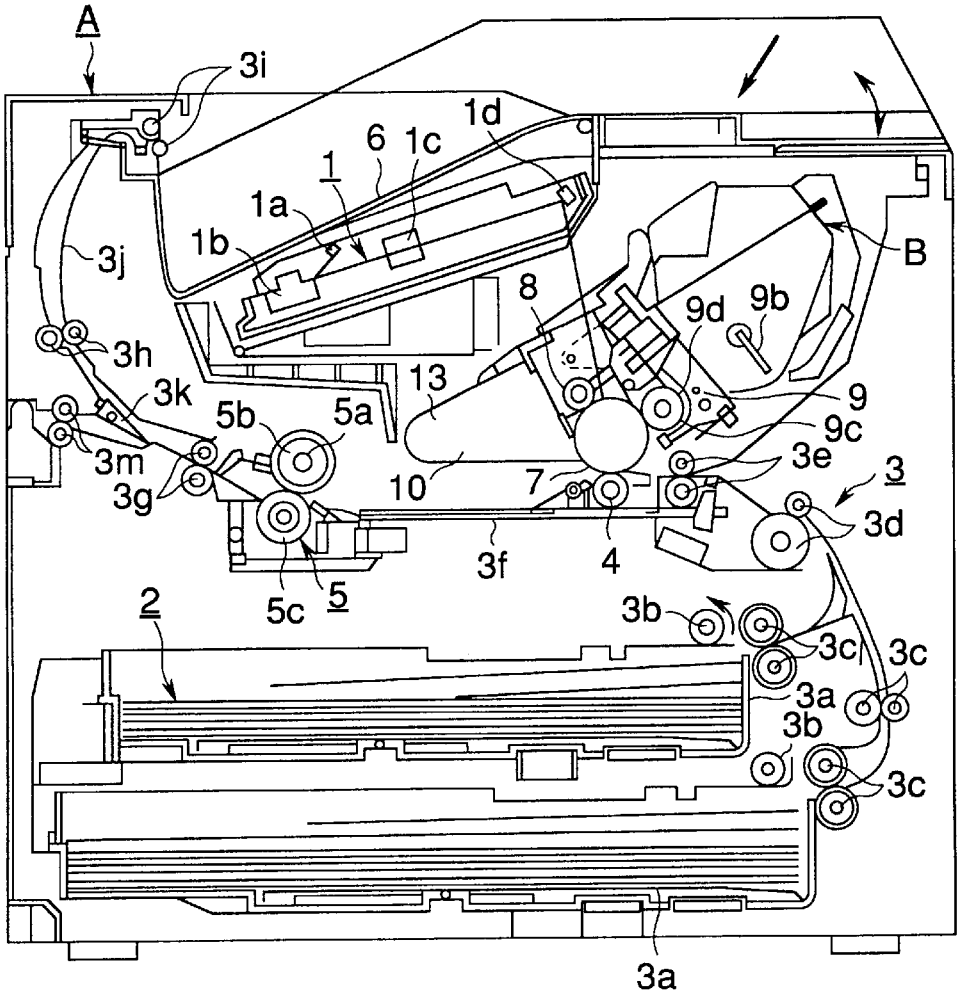
FIG. 2 is an explanatory sectional view showing a construction of the image forming apparatus according to the present invention.
Figure 3:
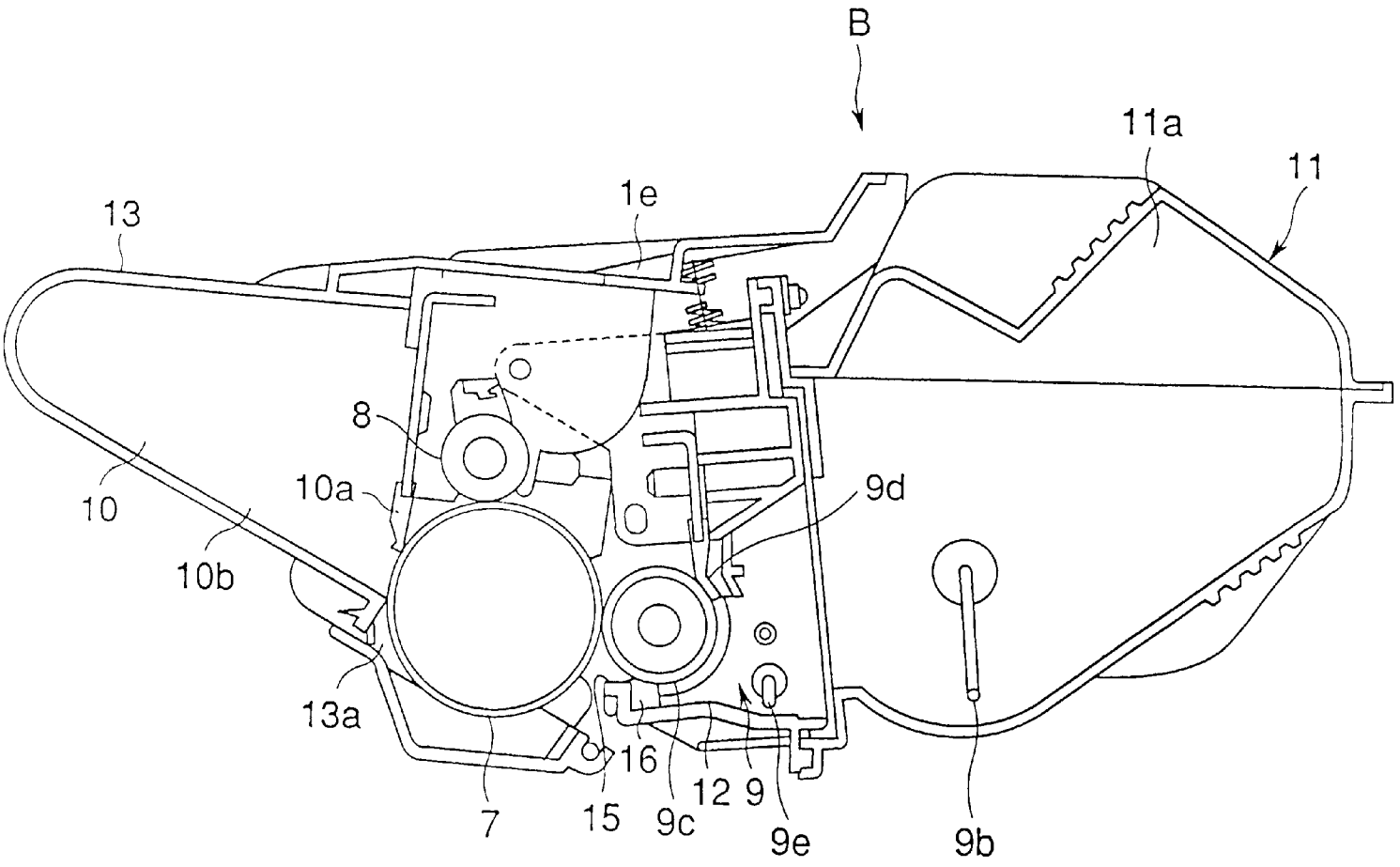
FIG. 3 is an explanatory sectional view showing a process cartridge according to the present invention.
Figure 4:
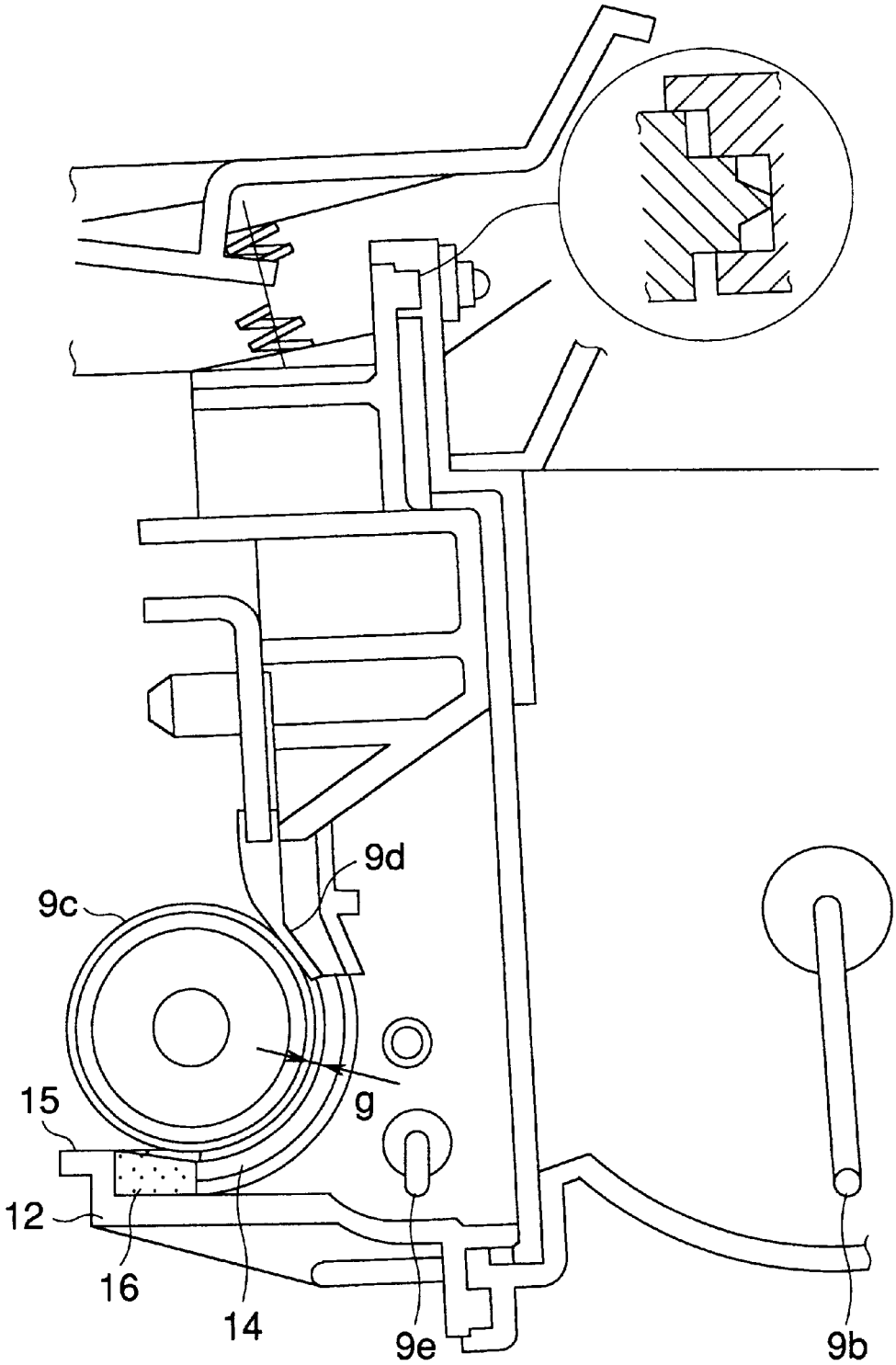
FIG. 4 is a partial enlarged view showing a developing apparatus according to a first embodiment of the present invention.
Figure 5:
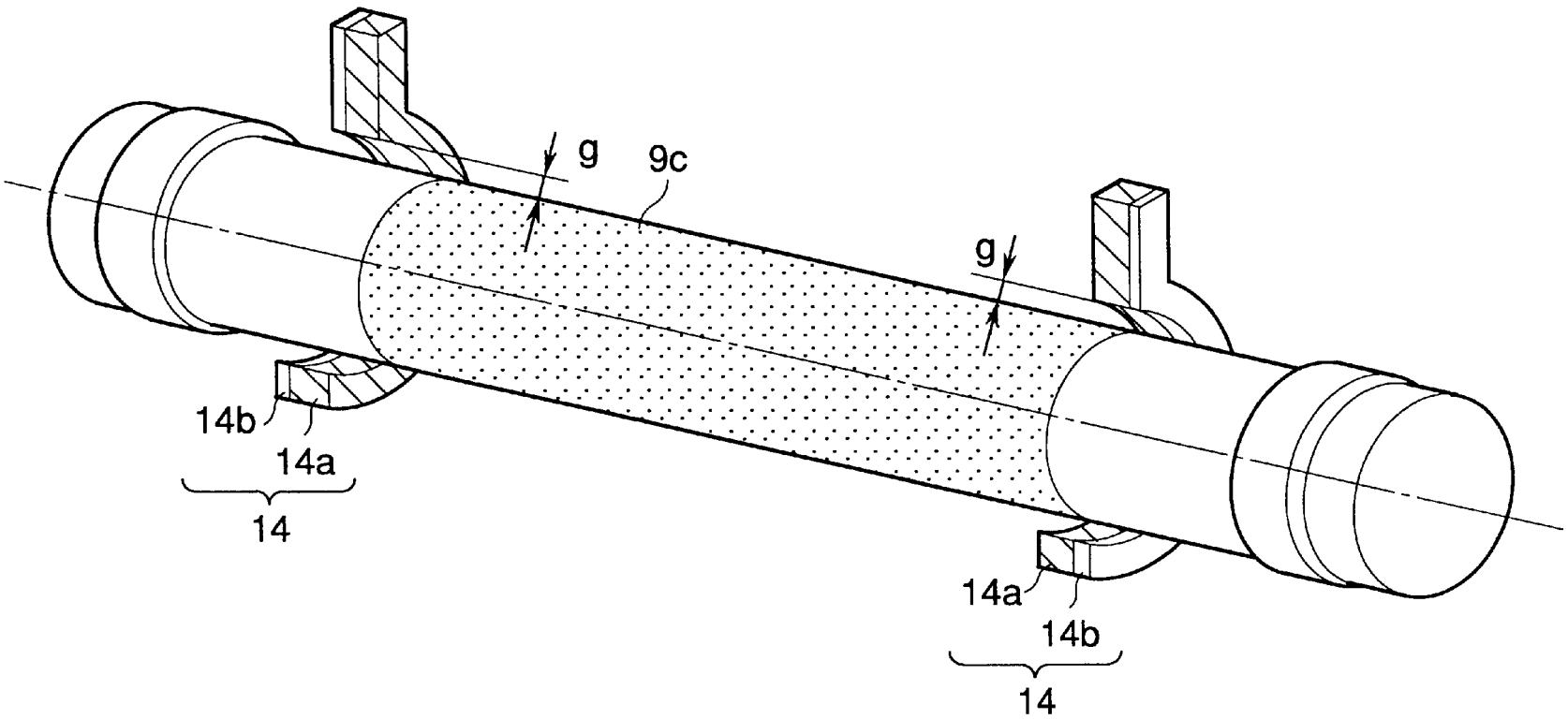
FIG. 5 is a perspective view showing a developing roller and magnetic sealing members.
Figure 6:
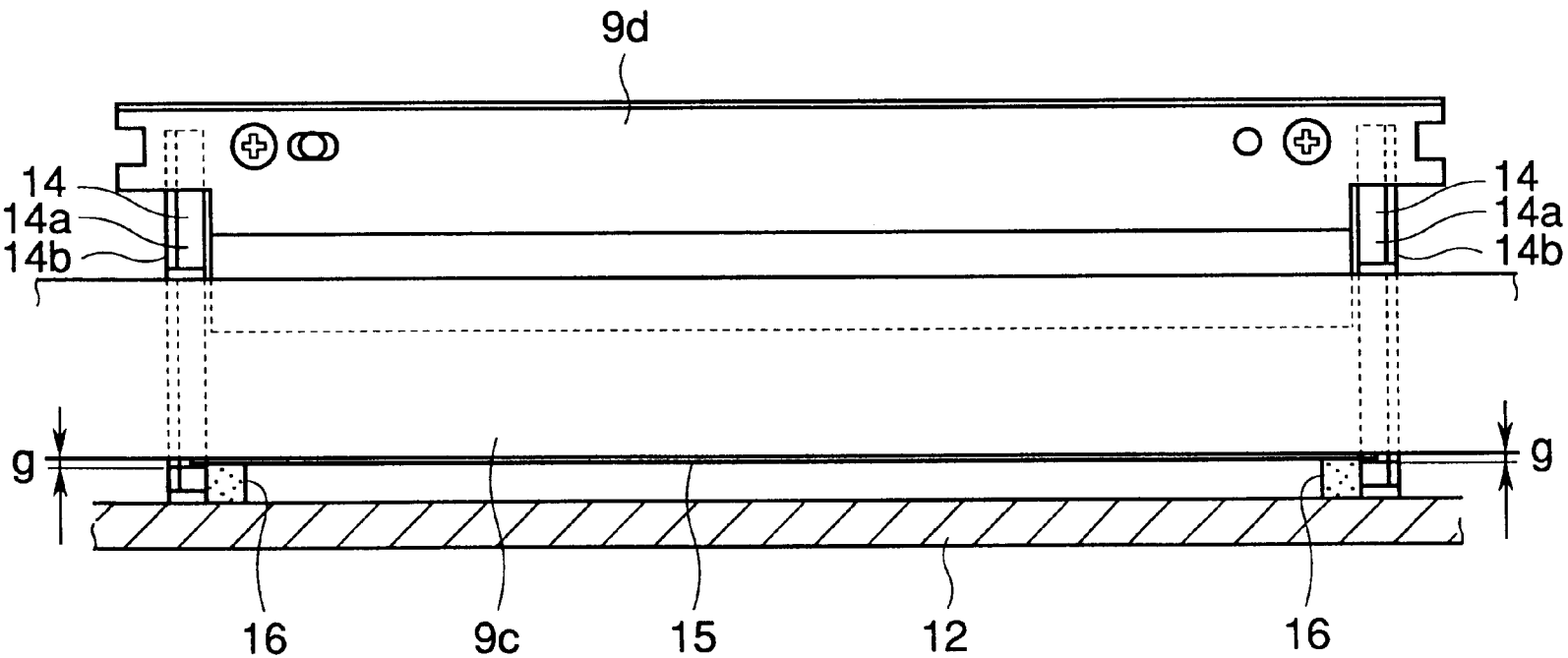
FIG. 6 is a front view of the developing apparatus according to the first embodiment of the present invention.
Figure 7:
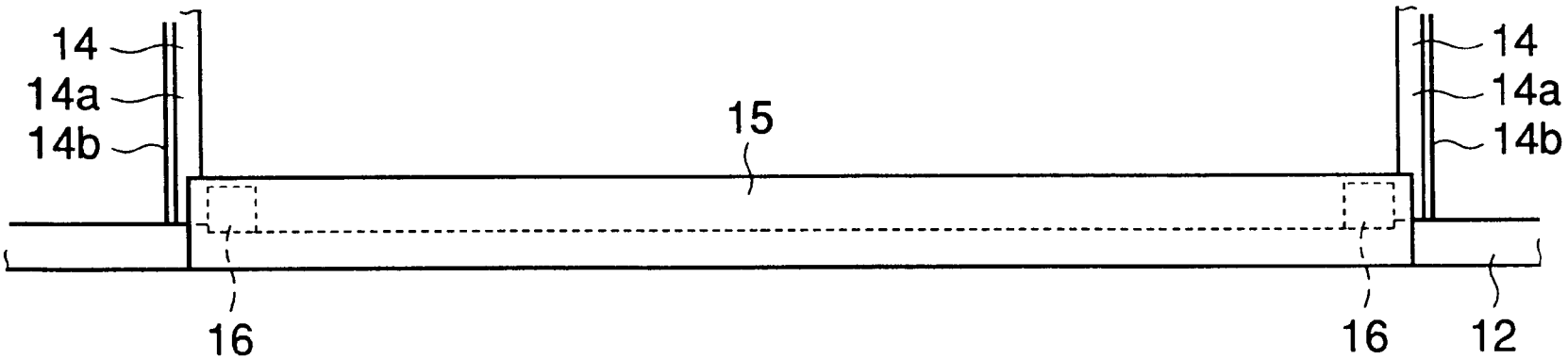
FIG. 7 is a partial enlarged view showing the developing apparatus according to the first embodiment of the present invention.

FIG. 1 is a perspective view of an image forming apparatus using a developing apparatus according to the present invention, FIG. 2 is a sectional view of the apparatus shown in FIG. 1, FIG. 3 is a sectional view of a process cartridge which can detachably be mounted to the apparatus shown in FIGS. 1 and 2, FIG. 4 is a partial enlarged sectional view of a developing apparatus according to an embodiment of the present invention, FIG. 5 is a partial perspective view of the developing apparatus of FIG. 4, FIG. 6 is a front view of the developing apparatus of FIG. 4, and FIG. 7 is a partial enlarged view of the developing apparatus of FIG. 4, looked at from the above.

In FIGS. 1 and 2, an image forming apparatus A serves to form an image on a recording medium 2 (made of paper sheet, synthetic resin or cloth) by using an electrophotographic image forming process. A toner image is formed on an electrophotographic photosensitive drum 7.

More specifically, after a surface of the photosensitive drum 7 is charged by a charge roller (charge means) 8, a laser beam corresponding to image information and emitted from an optical system (optical means) 1 is illuminated onto the photosensitive drum 7, thereby forming an electrostatic latent image corresponding to the image information.

The electrostatic latent image is developed by a developing means 9 to form a toner image. In synchronism with the formation of the toner image, the recording medium 2 is supplied from a sheet supply cassette 3*a* by means of a pick-up roller 3*b*, pairs of convey rollers 3*c*, 3*d* and a pair of regist rollers 3*e* in a reversing fashion.

Then, the toner image formed on the photosensitive drum 7 contained within a process cartridge B is transferred onto the recording medium 2 by applying voltage to a transfer roller (transfer means) 4. Thereafter, the recording medium 2 to which the toner image was transferred is sent to a fixing means 5 through a convey guide 3*f*. The fixing means 5 comprises a drive roller 5*c* and a fixing roller 5*b* containing a heater 5*a* therein. By applying heat and pressure to the recording medium 2 passing through the fixing means, the transferred toner image is permanently fixed to the recording medium.

Then, the recording medium 2 is conveyed by pairs of discharge rollers 3*g*, 3*h*, 3*i* through a reverse path 3*j* to discharge the recording medium 2 onto a discharge tray 6 in a face-down fashion. The discharge tray 6 is formed on an upper surface of the image forming apparatus A. Incidentally, by driving a rockable flapper 3*k*, the recording medium 2 can be discharged out of the apparatus by means of a pair of discharge rollers 3*m* in a face-up fashion without passing through the reverse path 3*j*.

In the illustrated embodiment, the pick-up roller 3*b*, pairs of convey rollers 3*c*, 3*d*, pair of regist rollers 3*e*, convey guide 3*f*, pair of discharge rollers 3*g*, 3*h*, 3*i* and pair of discharge rollers 3*m* constitute a convey means 3.

On the other hand, as shown in FIG. 3, in the process cartridge B, while the photosensitive drum 7 provided at its surface with a photosensitive layer is being rotated, the surface of the photosensitive drum is uniformly charged by applying a voltage to the charge roller 8 contacted with the photosensitive drum 7. Incidentally, the charge roller 8 is rotatingly driven by rotation of the photosensitive drum 7.

Then, the laser beam corresponding to the image information and emitted from the optical system 1 is illuminated onto the photosensitive drum 7 through an exposure opening 1*e* to form the electrostatic latent image. Incidentally, the optical system 1 includes a laser diode 1*a*, a polygon mirror 1*b*, a lens 1*c* and a reflection mirror 1*d*.

The electrostatic latent image is developed by the developing means 9 with magnetic toner. The developing means 9 serves to develop the electrostatic latent image formed on the photosensitive drum 7 by supplying the magnetic toner to a developing area of the photosensitive drum 7.

In the developing means 9, the magnetic toner contained within a toner container 11*a* is sent to a developing roller 9*c* by rotating a toner feed member 9*b*. By rotating the developing roller 9*c* containing a fixed magnet therein and by applying frictional charges to the toner by means of a developing blade 9*d*, a magnetic toner layer is formed on the developing roller 9*c*, thereby supplying the magnetic toner to the developing area of the photosensitive drum 7.

By transferring the magnetic toner onto the electrostatic latent image on the photosensitive drum 7, the electrostatic latent image is visualized as the toner image. The developing blade 9*d* serves to regulate an amount of the magnetic toner around the developing roller 9*c* and to apply the frictional charges to the toner. A toner agitating member 9*e* for circulating the magnetic toner within a developing chamber is disposed in the vicinity of the developing roller 9*c*.

After the toner image formed on the photosensitive drum 7 is transferred to the recording medium 2 by applying voltage having polarity opposite to that of the toner image to the transfer roller 4, residual toner remaining on the photosensitive drum 7 is removed by a cleaning means 10. In the cleaning means 10, the residual toner remaining on the photosensitive drum 7 is scraped by an elastic cleaning blade 10*a* and the scraped toner is collected into a waste toner reservoir 10*b*.

The process cartridge B is formed by joining a toner frame 11 having the toner container 11*a* containing the magnetic toner to the developing frame 12 for holding the developing means 9 such as the developing roller 9*c* and the like and by joining a cleaning frame 13 (to which the photosensitive drum 7, the cleaning means 10 such as the elastic cleaning blade 10*a* and the like and the charge roller 8 are attached) to the joined frames 11, 12. The process cartridge B can detachably be mounted to the image forming apparatus A by the operator.

The process cartridge B is provided with the exposure opening 1e through which the laser beam corresponding to the image information is illuminated onto the photosensitive drum 7 and a transfer opening 13*a* through which the photosensitive drum 7 is opposed to the recording medium 2. More specifically, the exposure opening 1e is formed in the cleaning frame 13 and the transfer opening 13*a* is formed between the developing frame 12 and the cleaning frame 13.

Next, a first embodiment of the magnetic toner sealing means around the developing roller 9*c* will be fully explained with reference to FIGS. 4 to 7. In FIGS. 4 to 7, magnetic seal members 14 for preventing the magnetic toner from leaking through both longitudinal ends of developing roller 9*c* are provided at the both longitudinal ends of the developing roller. Each magnetic seal member 14 is attached to the developing frame 12 with a small gap g between the seal member and the peripheral surface of the developing roller 9*c*.

Further, each magnetic seal member 14 is formed by joining a magnetic plate (magnetic member) 14*b* to an outer surface of a magnet 14*a* along the longitudinal direction of the developing roller 9*c*.

Now, explaining each magnetic seal member 14 in more detail, in each magnetic seal member 14, the magnet 14*a* (one of constructural elements) is formed from an injection-molded part having a width of 3 to 4 mm and having nylon binder including magnetic powder of Nd-Fe-B, and the magnetic plate 14*b* (the other constructural element) is formed from iron material having a thickness of 1 mm.

The magnetic plate 14*b* is joined to the magnet 14*a* by insert molding. However, the magnetic plate may be joined to the magnet by a both-face adhesive tape or a magnetic force alone. The small gap "g" between the developing roller 9*c* and the magnetic seal member 14 is 0.1 to 0.9 mm. In this case, magnetic flux density of the surface of the developing roller 9*c* given by the magnetic force of the magnetic seal member 14 is about 1000 to 2000 Gauss (Gs).

Regarding a positional relation between the magnet 14*a* and the magnetic plate 14*b* of the magnetic seal member 14, the magnet 14*a* is disposed inside along the longitudinal direction of the developing roller 9*c*, and the magnetic plate 14*b* is disposed outside of the magnet.

As another sealing means, an elastic sheet 15 made of sheet material such as PET (polyethylene terephthalate) or urethane is attached to the developing frame 12 along the longitudinal direction of the developing roller 9*c* and is urged against a lower part of the developing roller 9*c* by its own elasticity.

Both longitudinal ends of the elastic sheet 15 are overlapped with the magnetic seal members 14 along the longitudinal direction of the developing roller 9*c* so that both ends of the elastic sheet 15 are positioned within the small gaps g between the magnetic seal members 14 and the developing roller 9*c*.

In a longitudinal direction of the developing frame 12, rubber sponge members (elastic members) 16 for aiding abutment between the elastic sheet 15 and the developing roller 9*c* are provided on the developing frame 12 below the elastic sheet 15 and inside of the magnetic seal members 14. Each rubber sponge member 16 is formed from soft urethane foam having 30 to 150 cells/25 mm and having a thickness of 3 to 7 mm. In a condition that the developing roller 9*c* is attached to the developing frame 12, the rubber sponge members 16 are compressed by an amount of 0 to 4 mm.

With the arrangement as mentioned above, both longitudinal ends of the elastic sheet 15 are always urged against the developing roller 9*c* by the rubber sponge members 16. Thus, even when the magnetic seal members 14 (not contacted with the developing roller) effective as the magnetic toner sealing means for the ends of the developing roller 9*c* are used, both longitudinal ends of the elastic sheet 15 are stably urged against the developing roller 9*c* without separating from the developing roller by the magnetic toner existing within the small gap "g" between the magnetic seal members 14 and the developing roller 9*c*, thereby preventing the leakage of the magnetic toner.

Figure 8:
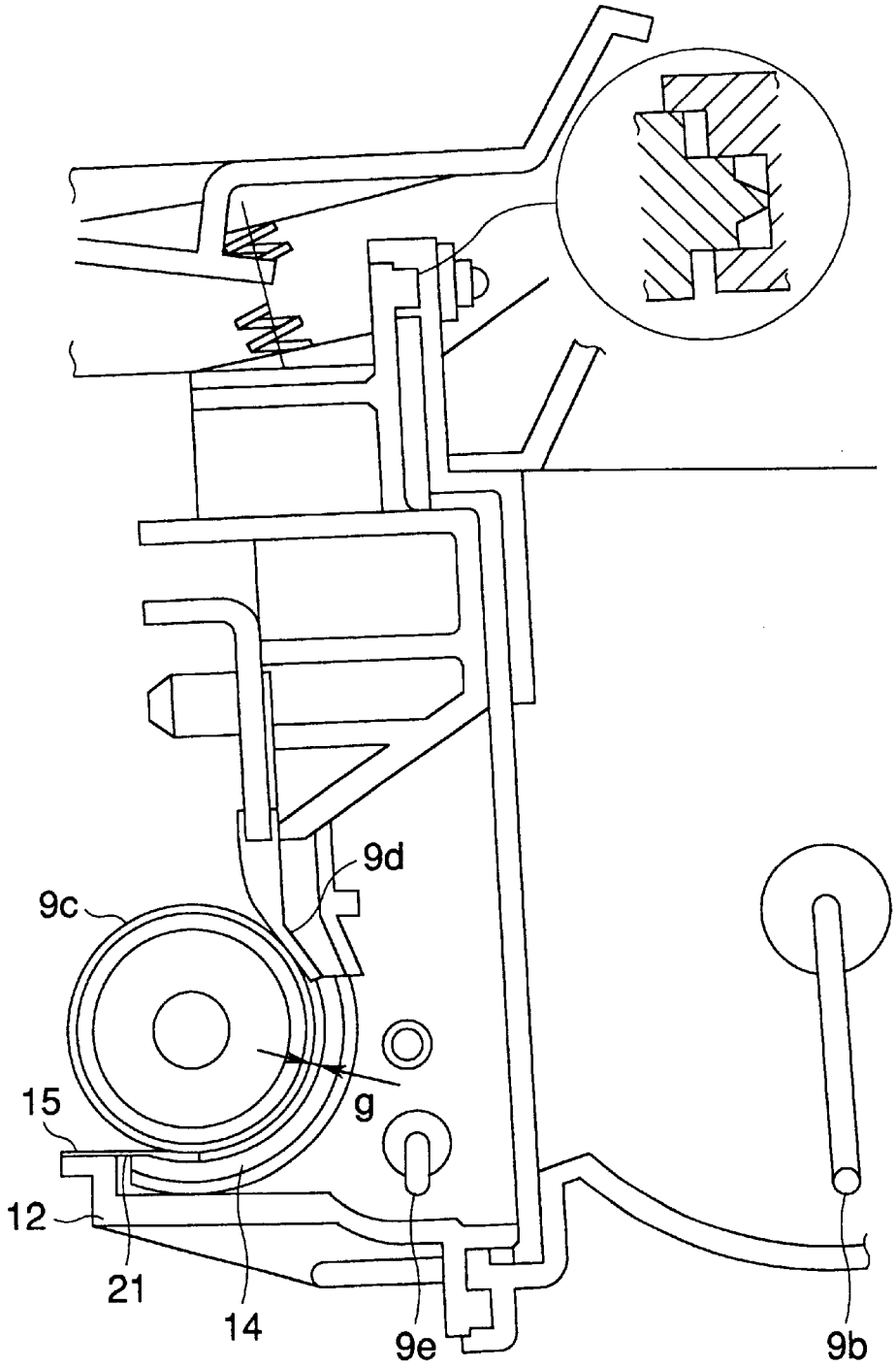
FIG. 8 is a partial enlarged view showing a developing apparatus according to a second embodiment of the present invention.
Figure 9:
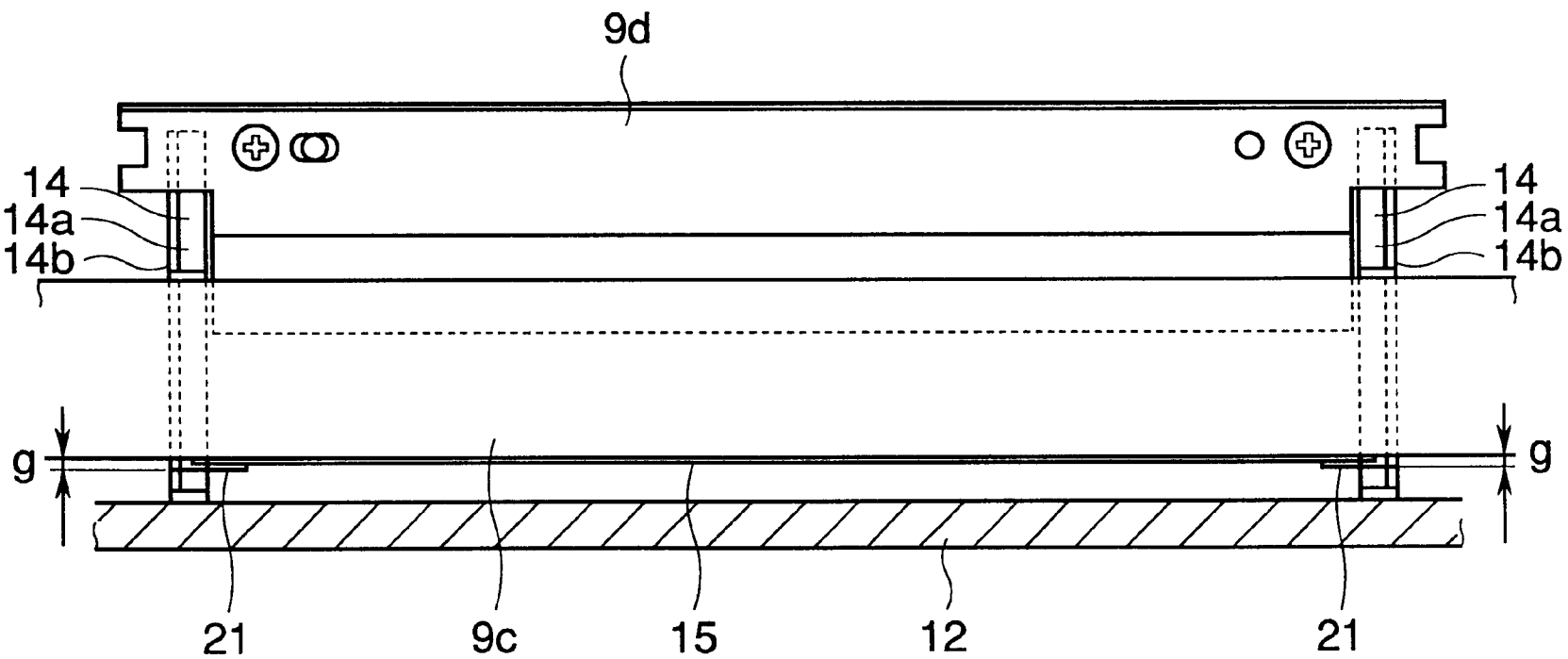
FIG. 9 is a front view of the developing apparatus according to the second embodiment of the present invention.
Figure 10:
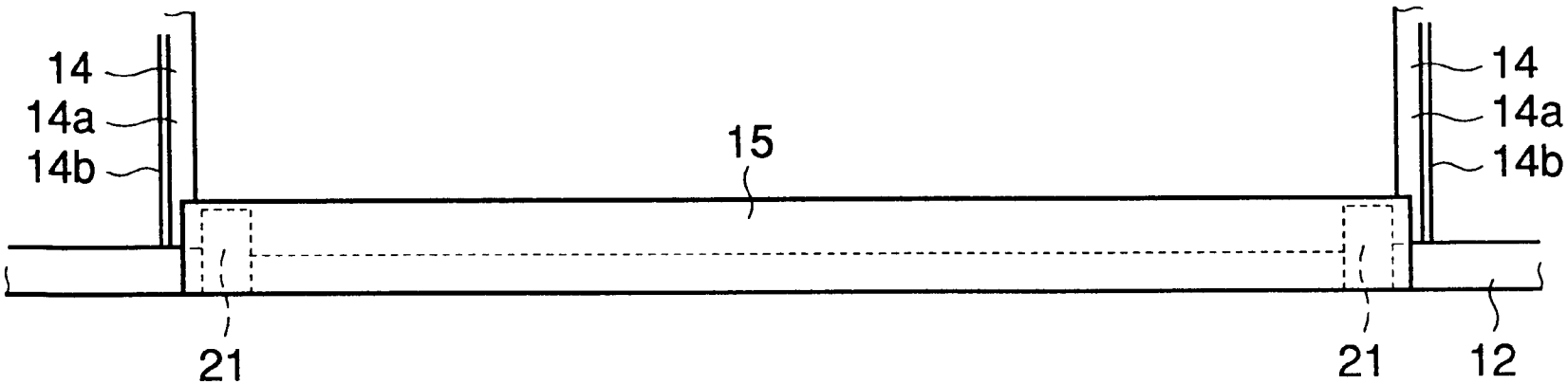
FIG. 10 is a partial enlarged view showing the developing apparatus according to the second embodiment of the present invention.

Next, a second embodiment of the present invention will be explained with reference to FIGS. 8 to 10. FIG. 8 is a partial enlarged view showing a developing apparatus according to the second embodiment of the present invention, FIG. 9 is a front view of the developing apparatus according to the second embodiment of the present invention, and FIG. 10 is a partial enlarged view showing the developing apparatus according to the second embodiment of the present invention. Incidentally, elements the same as those in the first embodiment are designated by the same reference numerals and explanation thereof will be omitted.

In the second embodiment, in a longitudinal direction of the developing frame 12, elastic sheet members (elastic members) 21 for aiding abutment between the elastic sheet 15 and the developing roller 9*c* are provided on the developing frame 12 below the elastic sheet 15 and inside of the magnetic seal members 14. The elastic sheet members are formed from PET (polyethylene terephthalate), urethane rubber, stainless steel or bronze phosphide.

With this arrangement, both longitudinal ends of the elastic sheet 15 are always urged against the developing roller 9*c* by the elastic sheet members 21. Thus, even when the magnetic seal members 14 (not contacted with the developing roller) effective as the magnetic toner sealing means for the ends of the developing roller 9*c* are used, both longitudinal ends of the elastic sheet 15 are stably urged against the developing roller 9*c* without separating from the developing roller by the magnetic toner existing within the small gaps "g" between the magnetic seal members 14 and the developing roller 9*c*, thereby preventing the leakage of the magnetic toner.

Figure 11:
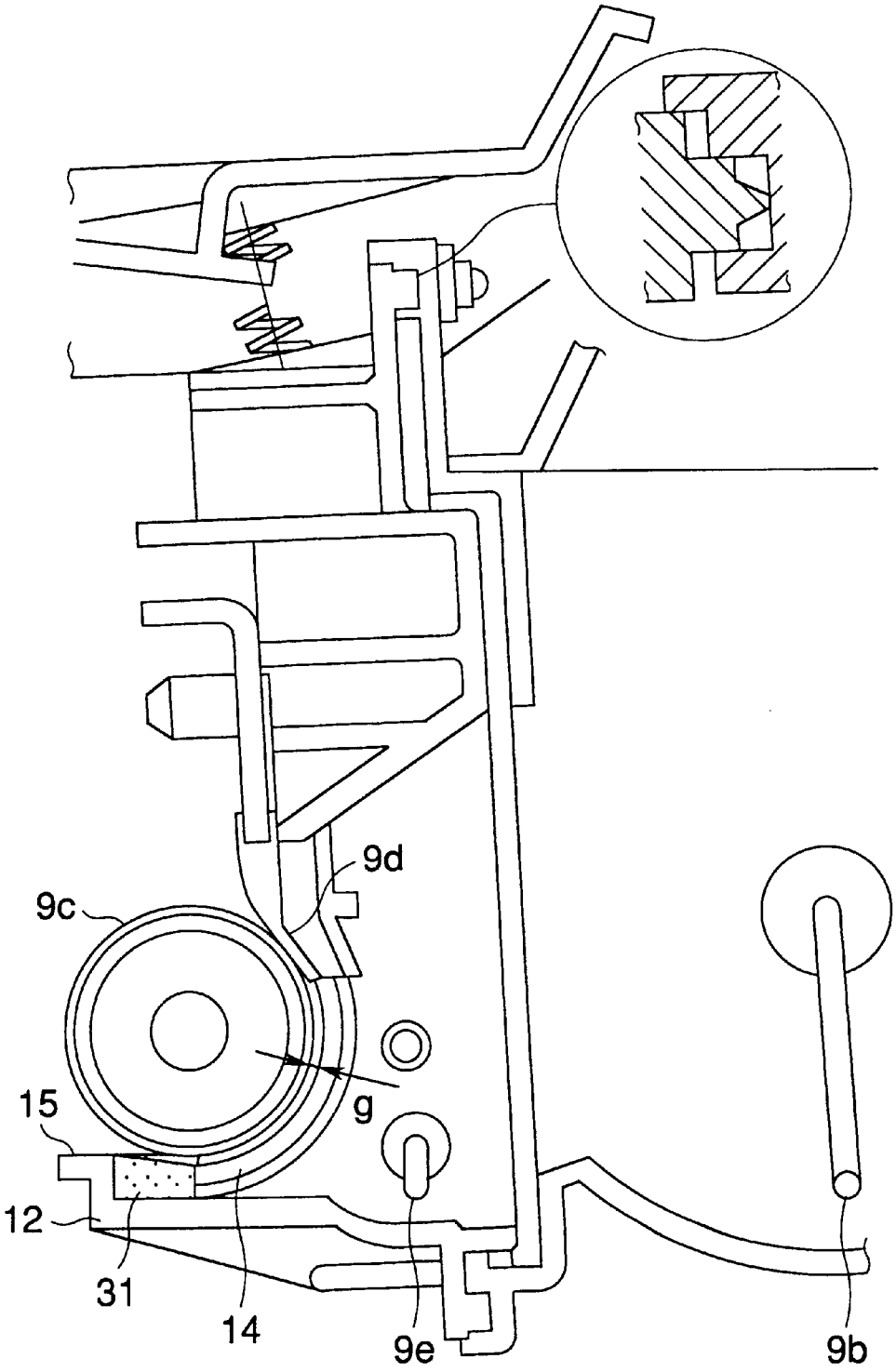
FIG. 11 is a partial enlarged view showing a developing apparatus according to a third embodiment of the present invention.
Figure 12:
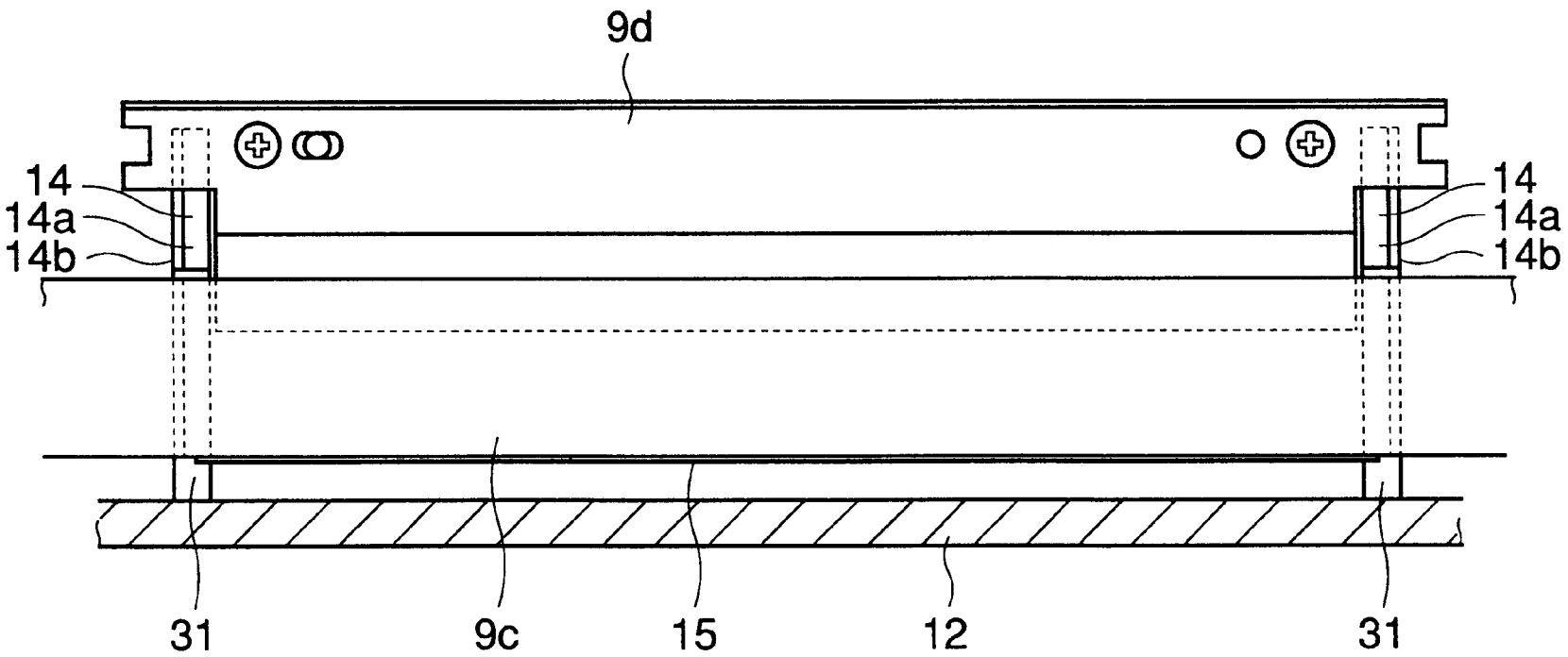
FIG. 12 is a front view of the developing apparatus according to the third embodiment of the present invention.
Figure 13:
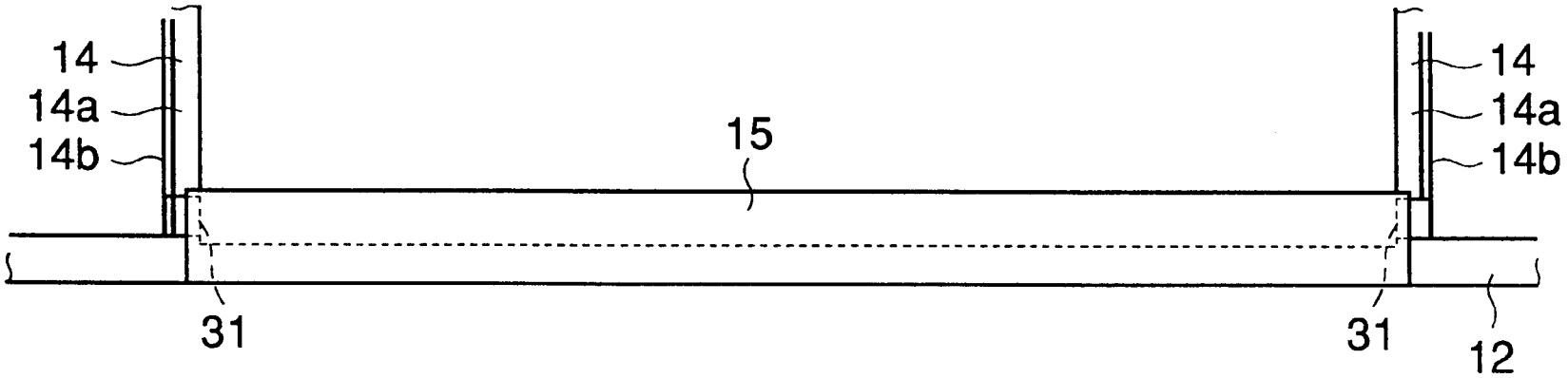
FIG. 13 is a partial enlarged view showing the developing apparatus according to the third embodiment of the present invention.
Figure 14B:
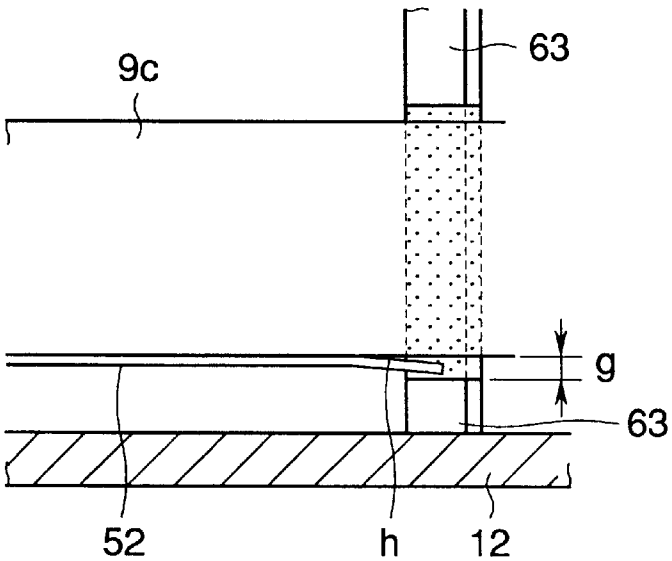
FIGS. 14A and 14B are views for explaining problems generated at ends of a developing apparatus.
Figure 14A:
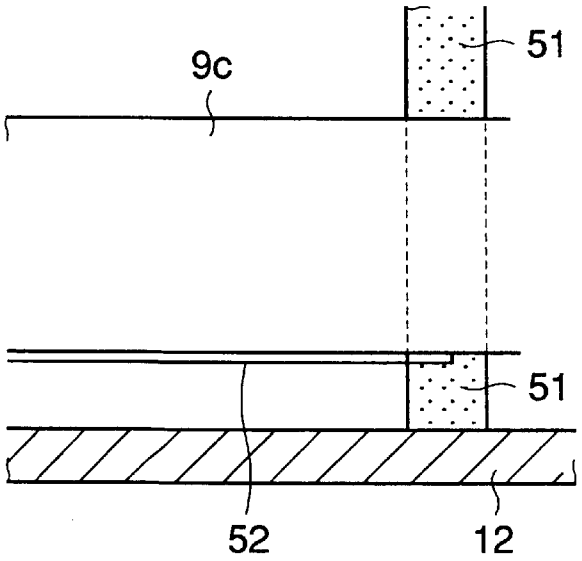

Next, a third embodiment of the present invention will be explained with reference to FIGS. 11 to 13. FIG. 11 is a partial enlarged view showing a developing apparatus according to the third embodiment of the present invention, FIG. 12 is a front view of the developing apparatus according to the third embodiment of the present invention, and FIG. 13 is a partial enlarged view showing the developing apparatus according to the third embodiment of the present invention. Incidentally, elements the same as those in the first embodiment are designated by the same reference numerals and explanation thereof will be omitted.

In the third embodiment, in a longitudinal direction of the developing frame 12, rubber sponge members (elastic members) 31 for aiding abutment between the elastic sheet 15 and the developing roller 9*c* are provided on the developing frame 12 below the elastic sheet 15 and within the magnetic seal members 14. The rubber sponge members 31 are made of the same material as those of the rubber sponge members 16 in the first embodiment.

With this arrangement, both longitudinal ends of the elastic sheet 15 are always urged against the developing roller 9*c* by the rubber sponge members 31. Thus, even when the magnetic seal members 14 (not contacted with the developing roller) effective as the magnetic toner sealing means for the ends of the developing roller 9*c* are used, the both longitudinal ends of the elastic sheet 15 are stably urged against the developing roller 9*c* without separating from the developing roller by the magnetic toner existing within the small gaps "g" between the magnetic seal members 14 and the developing roller 9*c*, thereby preventing the leakage of the magnetic toner.

While the present invention was explained with reference to the illustrated embodiments, the present invention is not limited to such embodiments, but, various alterations and modifications can be made within the scope of the invention.

What is claimed is:

1. A developing apparatus comprising:

a developing container for containing a magnetic developing agent;

a developing agent bearing member provided on an opening portion of said developing container to bear and convey the magnetic developing agent;

a sheet member elastically biased against said developing agent bearing member along a longitudinal direction of said developing agent bearing member to close a gap between said developing agent bearing member and said developing container;

a magnetic seal member provided at an end of said developing agent bearing member with a gap therebetween to form a magnetic seal; and an elastic member provided proximate to the end of said developing agent bearing member and adapted to bias a vicinity of an end of said sheet member in a longitudinal direction thereof against said developing agent bearing member.

2. A developing apparatus according to claim 1, wherein the end of said sheet member in the longitudinal direction thereof is overlapped with said magnetic seal member along the longitudinal direction of said developing agent bearing member.

3. A developing apparatus according to claim 1, wherein said sheet member is formed from an elastic material so that it is biased against said developing agent bearing member by its own elasticity.

4. A developing apparatus according to claim 1, wherein said elastic member is provided on said developing container.

5. A developing apparatus according to claim 1, wherein said elastic member is formed from sponge rubber.

6. A developing apparatus according to claim 1, wherein said elastic member is disposed inside of said magnetic seal member in the longitudinal direction of said developing agent bearing member.

7. A developing apparatus according to claim 1, wherein said developing apparatus is formed as a unit integral with an image bearing member for bearing an electrostatic latent image, and said unit can detachably be mounted to an image forming apparatus.

8. A developing apparatus according to claim 1, wherein, in the longitudinal direction of said sheet member, an edge of the end of said sheet member is provided outside of an edge of an outer end of said elastic member.

* * * * *

UNITED STATES PATENT AND TRADEMARK OFFICE

CERTIFICATE OF CORRECTION

PATENT NO. : 6,044,237

DATED : March 28, 2000

INVENTOR(S) : ATSUSHI NUMAGAMI, ET AL.

It is certified that error appears in the above-identified patent and that said Letters Patent is hereby corrected as shown below:

COLUMN 1

Line 42, "developing" (second occurrence) should read --the developing--; and

Line 43, "the both" should read --both--.

COLUMN 2

Line 5, "gaps h." should read --gaps "h".--.

COLUMN 5

Line 1, "gap g" should read --gap "g"--; and

Line 38, "gaps g" should read --gaps "g"--.

COLUMN 6

Line 49, "the" (last occurrence) should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*